United States Patent [19]

Vermot-Gaud et al.

[11] Patent Number: 4,600,322

[45] Date of Patent: Jul. 15, 1986

[54] NEEDLE MATRIX PRINTER

[75] Inventors: Jacques Vermot-Gaud, Perly; Didier Joyeux, Petit-Lancy, both of Switzerland

[73] Assignee: Battelle Memorial Institute, Geneva, Switzerland

[21] Appl. No.: 707,374

[22] Filed: Mar. 1, 1985

[30] Foreign Application Priority Data

Mar. 7, 1984 [CH] Switzerland ..... 1124/84

[51] Int. Cl.[4] ..... B41J 3/12

[52] U.S. Cl. ..... 400/124; 101/93.05; 400/121

[58] Field of Search ..... 400/121, 124, 157.2, 400/118, 119; 101/93.04, 93.05

[56] References Cited

U.S. PATENT DOCUMENTS 3,918,567 11/1975 Kittredge ..... 101/93.04 X
4,083,299 4/1978 Norton ..... 400/157.3 X
4,211,493 7/1980 Costello ..... 400/121
4,272,200 6/1981 Hehl ..... 400/124

FOREIGN PATENT DOCUMENTS 1423518 2/1976 United Kingdom ..... 400/121
867682 9/1981 U.S.S.R. ..... 400/121

*Primary Examiner*—Paul T. Sewell
*Attorney, Agent, or Firm*—Cushman, Darby & Cushman

[57] ABSTRACT

The needles (1) of this printer are fed by an electrical conductor (10) associated with the secondary of a step-down transformer (9) connected to a current pulse generator (8). The needle (1) having been placed in the magnetic field of a permanent magnet (7), the current (I) which passes through the needle gives rise to forces which tend to restore this needle to a straight line joining its points of support and guidance (2,3) while displacing the free end against a writing support.

9 Claims, 11 Drawing Figures

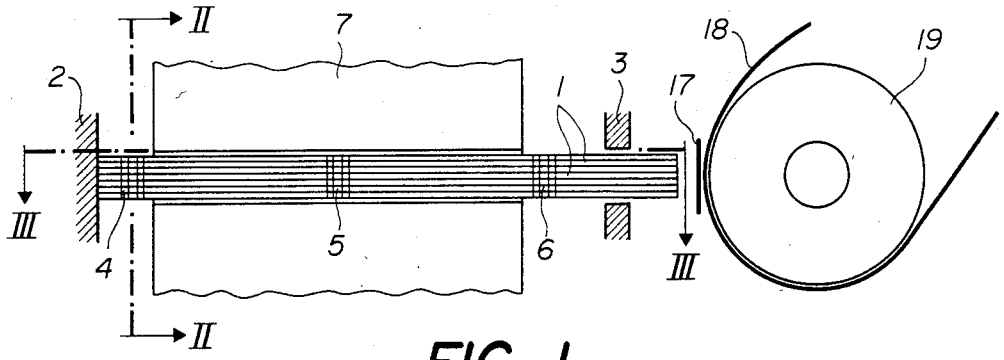
FIG. 1
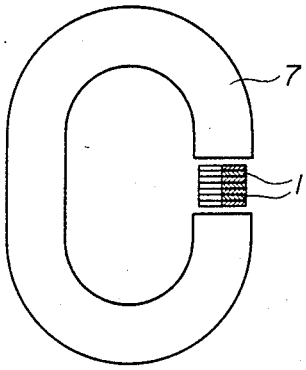
FIG. 2
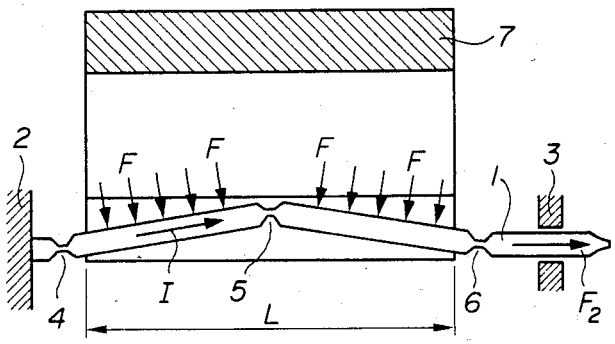
FIG. 3
FIG. 4
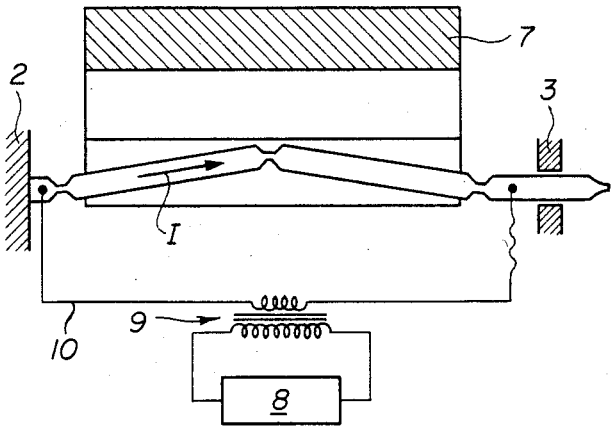

FIG. 5
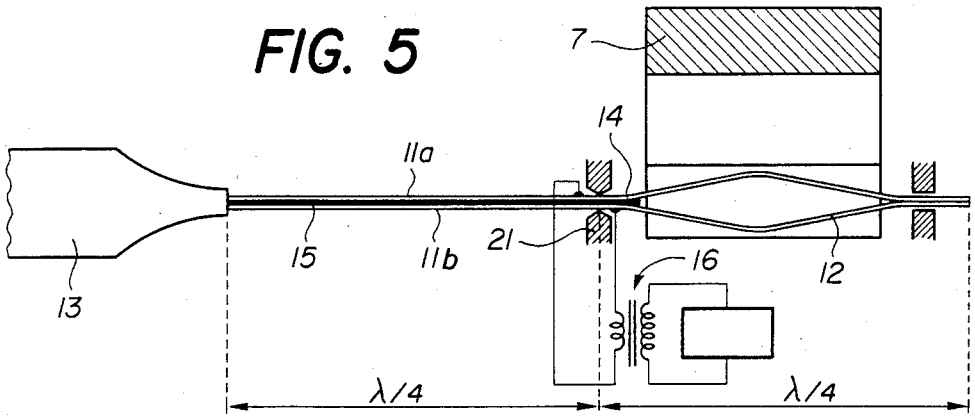
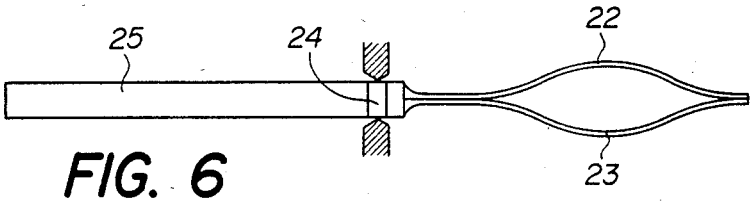
FIG. 6
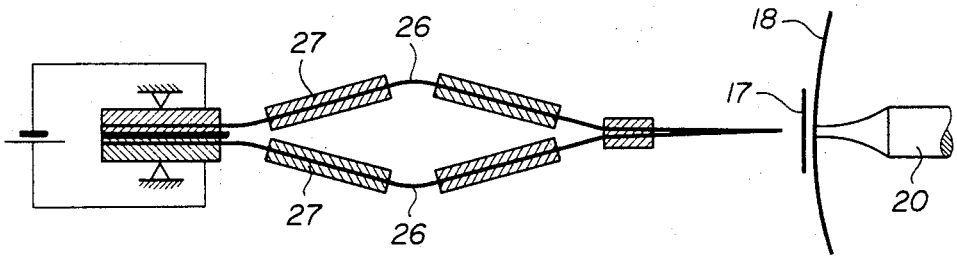
FIG. 7
FIG. 8
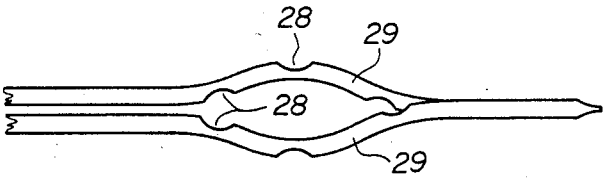

NEEDLE MATRIX PRINTER

The present invention relates to a needle printer comprising a set of needles each of which is connected to a support and has one free end, further comprising means for guiding these needles and means for applying said free ends selectively to a writing surface associated with pressure-sensitive marking means, each needle being made from an electrical conductor one portion of which is laterally offset from an axis which connects said guiding means to the fixed end of said support, and which is connected across said portion to the two respective poles of a source of current, a magnetic field source being disposed so as to create a field which, in the presence of a current in said part of the conductor, generates electrodynamic forces tending to restore said portion towards said axis or displace it from said axis as the case may be, depending on the sense of the current.

A mode of electrodynamic action for a printing needle has already been proposed in GB-A- No. 1 423 518, and in particular in the embodiment of FIG. 4 of that document. According to that embodiment, a loop is formed in the portion of the conductor which is laterally offset from the guide axis of the needle. This loop is disposed in a plane perpendicular to the plane which contains the rest of the conductor and the rest of its laterally offset portion. One magnetic pole is positioned opposite said loop with its diverging flux oriented to penetrate this loop. When a current flows in the loop of the conductor, the latter has a tendency to enclose the maximum flux. When the latter, i.e. the flux, is diverging and the magnetic pole is adjacent the guide axis of the conductor, the loop is drawn toward that axis and the free end of the needle is pushed toward the writing surface.

Since the plane of the conductor and that of the loop for cooperating with the diverging magnetic field are necessarily perpendicular, such a proposal does not allow of the massing of many needles to make a matrix printer. Moreover it must be said that this document is silent on how to make such a printer with the aid of this embodiment. But a single needle does not constitute a printer. so that logically it can be admitted that this embodiment does not constitute an industrial solution, inasmuch as it does not by itself enable the expert to produce a needle matrix printer based on the principle described by FIG. 4 of the above-mentioned document.

Accordingly the object of the invention is to fill this gap by a proposal which makes possible the electrodynamic action not of one needle merely, but of a plurality of needles forming a matrix printer.

This invention therefore provides a needle matrix printer comprising a set of needles each of which is connected to a support and has one free end, guide members for these needles, and means for applying said free ends selectively against a writing surface associated with pressure-sensitive marking means, each needle being made as an electrical conductor of which a portion is offset laterally of an axis joining said guide means to the integral end of said support and which needle is connected across said portion to the two respective poles of a current sources, a magnetic field generator being disposed so as to create a field which, in the presence of a current within said portion of the conductor, gives rise to electrodynamic forces tending to further offset said portion from said axis or to restore it thereto as the case may be, according to the sense or direction of the current, characterized by the fact that said portion is contained in a plane common to the remainder of the electrical conductor which forms said needle, and that the poles of said magnetic field generator are disposed on either side of this plane to give a uniform field whose lines of force are perpendicular to said plane.

The proposal is simple. It enables all the needles of the printer to be massed in the air gap of the same magnet, while only those needles fed with current pulses move. The bulk of such a printer can be substantially reduced by reason of the needles being arranged in mass formation.

Other advantages of this invention will appear from the following description and the drawing which accompanies it and illustrates, schematically and by way of example, different versions of the needle matrix printer which forms the subject-matter of the present invention.

FIG. 1 is a side elevation of an embodiment of this needle matrix printer;

FIG. 2 is a view along the line II—II of FIG. 1;

FIG. 3 is a view along the line III—III of FIG. 1;

FIG. 4 shows a mode of feeding electric current to this needle;

FIGS. 5 and 6 show two variants of needle;

FIG. 7 shows a mode of selective stiffening of a needle;

FIG. 8 shows another needle variant with different zones of rigidity and of electrical conductivity;

Figure 9:
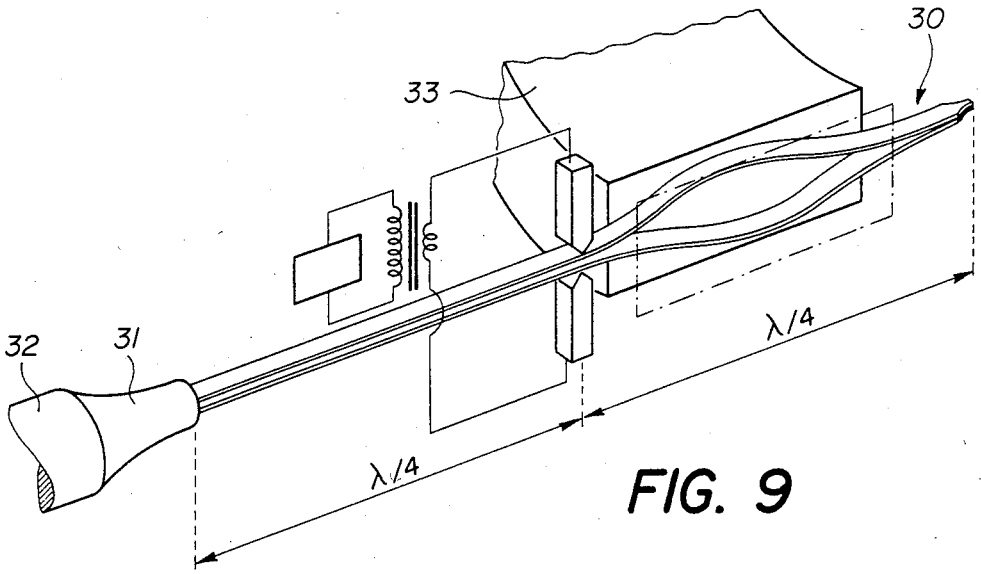
FIG. 9 is a perspective view of a needle variant for transmitting ultrasounds.

The embodiment of FIGS. 1–3 illustrates the principle of the electrodynamic action of the needle printer according to the invention. The head of this printer carries a series of needles 1 of rectangular cross-section, stacked one upon another with an electrically insulating layer between them. These needles are secured at their rear ends to a support 2 and pass through a guide 3 located adjacent their front ends. These needles 1 have three points of articulation 4, 5 and 6 between the support 2 and the guide 3, so that the needles 1, with the straight line joining the articulation points 4 and 6, form a very flattened isosceles triangle. This portion of the needles 1 is disposed in the air gap of a permanent magnet 7. Opposite the front ends of the needles 1, there is placed upon a support 19 a bundle comprising at least one inking pad 17 and one sheet 18 to be printed.

When a current I is made to pass through a needle, forces F operate on it and tend to restore it to the straight line joining the articulation points 4 and 6.

$$\Sigma F = LIB$$

where F is in newtons, B in teslas, I in amperes and L in meters.

If the length L has a value of 4 cm, the magnetic field B a value of 1 tesla, and the current I a value of 10 A, then the force $\Sigma F = 0.4$ N, which gives a force $F_2$ of the order of 2 N to the needle's end, the ratio $F_2/F_1$ being a function of the magnitude of the displacement of the articulation point 5.

This proposal has important advantages. It can be noted that the stacking of the needles 1 allows the height of the print characters to be obtained directly, without having to make the needle points converge. The application of forces F distributed over the whole length of the isosceles sides of the triangle produces a natural stiffening of the needle. According to the sense of the current pulse, the action of the forces F is positive, as illustrated. or negative, which permits positive command of the advancing and retreating movement of the points of the needles 1.

FIG. 4 illustrates the electrical feed of the needles 1. It comprises a current pulse generator 8, a step-down transformer 9, a conductor 10 which has one end connected to the needle 1 near its fixed support 2 and the other, flexible end connected near the other end of the needle 1. so that the current I flows along the isosceles sides of the needle 1.

The electrical resistance of the electric circuit which encompasses the portion of the needle and the secondary of the transformer is of the order of, for example, 0.01 to 0.1 ohm, so that the current is of the order of 1-20 A.

To produce such a current pulse, one may have recourse, with advantage, to a transformer of 200 primary and 10 secondary turns. Thus 0.5 A on the primary corresponds to 10 A on the secondary. If the resistance of the needle actuating circuit has a value of 0.02 ohm, the secondary is at 0.2 volt and the primary at 10 volts.

To produce a pulse with a total duration of 0.5 ms, the ferrous cross-section of the transformer should be about 0.3 $cm^2$. We are accordingly concerned with very small transformers which can be positioned on the printing head or externally thereof and can rest immobile.

We turn to examine the dynamic behaviour of a needle so as to evaluate the limits of the printing velocity of the head formed from such needles. It is convenient, to this end, to consider the needle as a rod fixed at both ends and to determine its intrinsic frequency. With a rod of rectangular section, the fundamental frequency is $$F_o = 3.2\ h/l^2 \cdot \sqrt{E/k}$$

where k=density in $g/cm^3$,

E=Young's modulus in $N/m^2$, h and l=width and length of the needle in cm.

For a copper alloy needle $k=9\ g/cm^3$, $E=12\times10^{10}\ N/m^2$, $h=1.5\times10^{-2}$ cm, l=2.5 cm. $F_0\cong885$ Hz. For a similar needle in molybdenum, $k=10.2\ g/cm^3$, $E=35\times10^{10}\ N/m^2$, $F_o\cong1420$ Hz.

Such frequencies allow one to envisage printing velocities of the order of 1000 to 1500 dots per second. and even more if the parameters are optimized.

It is possible likewise to utilize the needle's capacities for auto-oscillation to amplify the printing energy, which corresponds to the kinetic energy of the needle during its tranverse movement. In order to do it in the most favourable manner, it is necessary to adopt a "negative-positive" type of command mode, which consists of first sending the needle a "negative" current pulse causing the retreat of the needle point by displacing its articulation 5 from the axis which connects the anchorage point on the support 2 with the guide block 3, and thus priming an oscillation, then sending a "positive" current pulse whose effect is added to the natural oscillatory return movement of the needle.

In the case of the variants of FIGS. 5 and 6 two symmetrical needles 11*a* and 11*b* are secured together forming a loop 12. An electrical insulator 15 separates the two needles. running from the support 13 to the first articulation point 14, between the adjacent parts of the two needles. The insulated parts of these two needles are connected respectively to the two ends of the secondary of the feed transformer 16. The current pulses thus traverse the loop 12 which is situated. as described previously, within the magnetic field of a magnet 7. In this variant, the forces induced across the two needles 11*a* and 11*b* are opposed, and the resultant force of the needles is doubled. The support 13 to which the rear end of this double needle 11*a* and 11*b* is fixed, is, in this example, an ultrasonic transducer located at a distance $\lambda/4$ from its nodal fixing point 21 likewise located at a distance $\lambda/4$ from the free end of the double needle 11*a*,11*b*. In the case where the needles 11*a* and 11*b* do not transmit ultrasound, the part of these needles located behind the support 21 can be omitted.

The FIG. 6 variant shows a double needle 22, 23 whose rear ends are secured to an oscillator 24 formed by a ceramic, i.e. an insulator disc, of diameter e.g. 5 mm, located on the nodal support point and fixed to the end of a steel rod 25. In this variant, the oscillator for generating the ultrasonic vibrations is thus integral with the needle.

There are various proposals for making needles with inflection points playing the part of joints. However, it is necessary to distinguish between two cases; the one where the needle is an acoustic fibre for transmitting ultrasonic vibrations, and the one where it is no such thing, either because it is intended to print by other means, e.g. by pressure alone, or because the needle is intended to press part of the bundle comprising the inking pad 17 and the paper 18 against a backing 19 made up of a vibrating surface integral with an ultrasonic transducer 20 (FIG. 7). In the case where the needle is not an acoustic fibre, the constraints are limited to the electrical resistance and the mass, both of which should be as low as possible. The inflection points should be as flexible as possible, while increasing the electrical resistance as little as possible. The thickness of the needle within the air gap of the permanent magnet should be as small as possible.

If, for example, one allows it an air gap of 0.2 mm and a return movement with a slope from the straight having a tangent of 25, the magnetic length can be restored to $$0.2\times25=12.5\ mm\simeq1.2\ cm.$$

In such a case, samarium cobalt is no longer necessary, since Ticonal 800 suffices.

Likewise the magnetic inductance can be strengthened by concentrations of pure iron as will be shown below.

Finally, in making a head by stacking needles as shown by FIGS. 1-3, in which the offsetting of the points is 2.6 mm/8=0.325 mm, the needles can be stacked without needing to have their points converge. the stacking corresponding to the height of the characters to be printed. Furthermore, in addition to the self-stiffening of the needles effected by the forces over the entire part of the needle located within the magnetic field. the magnets also serve as guide members.

The stacked needles can be insulated from each other by varnishes or by fine ceramics; this insulation can equally serve to shield the needles from the magnets.

The points of the needles can likewise be insulated by a covering of glass or equivalent material covering the end of the needle or the support surface 19 of the bundle comprising the inking pad 17 and the paper 18.

It should be noted that, because of the use of transformers to feed the electrodynamically-acting needles, it is not absolutely necessary to ensure that the needle points are insulated. Indeed, they can be regarded as being at a reference potential.

There exist various means for producing less rigid inflection points when the needle is not intended for transmitting ultrasound. That is why, as shown in FIG. 7, two wires 26 of 50 μm diameter stainless steel can be taken and, in regions of greater rigidity and electrical conductivity, coated with aluminium to form small rods 27 which can have a thickness of 0.15 mm and a length of 2 mm, for example, and are spaced apart by 4 mm gaps.

In the case of the FIG. 8 variant. the inflection points are weakened by notches 28 made into the width of the leaves 29 which have a rectangular section.

In order to achieve the production of a printing needle which is also an acoustic fibre for transmitting ultrasonic vibrations, many conditions have to be satisfied in addition to the section of the fibre being uniform. FIG. 9 illustrates one embodiment of such a needle. This needle 30 consists of two leaves of rectangular section $1\times0.15$ mm attached across their 1 mm wide faces and secured at their rear ends to an amplifier 31 connected to an ultrasonic transducer 32. The overall length of the needle is an integral multiple of $\lambda/2$ whereas the point of support of this needle is located at a node corresponding to $\lambda/4$. The two rear portions of the leaves of the needle 30 are electrically isolated by an insulating varnish, and these leaves are connected, at their nodal point of support, to a feed source similar to those previously described. In such a case it is the major axis of the section of the leaves of the needle 30 which defines the air gap of a permanent magnet 33. The leaves of the needle 30 are of metal alloy having adequate elastic mechanical properties (typically 40 kg/mm$^2$ at least) with at the same time a resistance as low as possible. By way of example. one might mention the alloys of hard copper (CuAg to CuCd, phosphor bronze); pure metals such as molybdenum; composite materials such as silver with a precipitate of MgO or of molybdenum or of steel covered with copper.

If the width of the leaves exceeds 0.35 mm, it is still possible to create a printing head by stacking of the needles, but in that case it is necessary to provide that the needle points shall converge.

Figure 10:
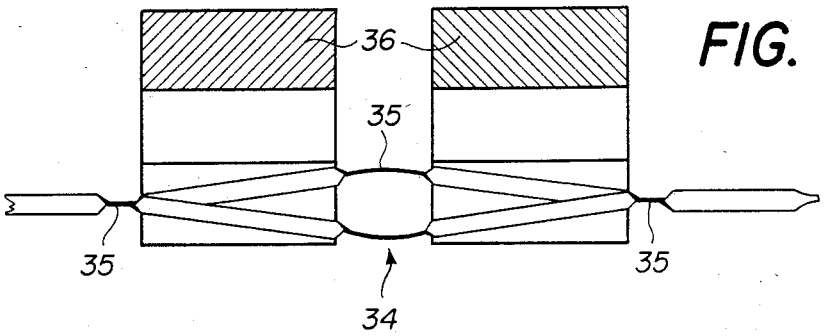
FIG. 10 is an elevation of another needle variant for transmitting ultrasounds.

FIG. 10 shows a needle variant 34 in which the less rigid inflection zones 35 are constructed by twisting the rectangular section, which constitutes the needle, through 90° about its longitudinal axis so that the width of these leaves shall be perpendicular to the direction of the forces generated by the electrodynamic effect of the magnets 36 on the leaves of the needle 34 when said leaves are pervaded by an electric current. On the other hand, between the magnets 36 it is the thickness of the leaves which defines the air gap. When the width of the leaves is in the plane of the air gap, their rigidity in that portion is consequently greater, compared with the forces exerted, than that of the inflection zones, and the air gap is minimal.

Figure 11:
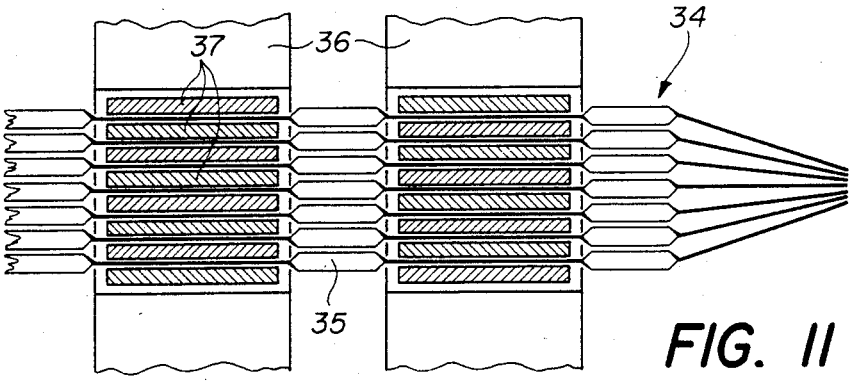
FIG. 11 is an elevation of a printing head according to the variant of FIG. 10.

FIG. 11 shows how to create a multiple-needle printing head of needles of this kind. Since such needles cannot be purely and simply stacked, the stacking of the needles 34 can be achieved by placing between them iron blades 37 to compensate for the difference between the width of the leaves in the less rigid inflection regions 35 and the thickness of the leaves in the more rigid parts which unite said inflection regions 35. These iron blades allow a reinforcement of the induction by playing the part of concentrators, and thus lead to a weakening of the air gap effect. But the ends of the needles 34 should be made to converge mutually and on either side of the needle situated at the centre of the printing head.

Finally it should be noted that the needles can likewise comprise round wires of uniform section or specially shaped in the regions of greater flexibility. Indeed, many tests have permitted verification of the good behaviour of the round wire.

One alternative likewise consists of slightly flattening the round wire so as to obtain a round-edged strip with a thickness/width ratio of $\frac{2}{3}$.

We claim:

1. Needle matrix printer comprising a set of needles each of which is connected to a support and has one free end, guide members for these needles, and means for applying said free ends selectively against a writing surface associated with pressure-sensitive marking means, each needle being made as an electrical conductor of which a portion is offset laterally of a straight line joining said guide means to the integral end of said support and which needle is connected across said portion to the two respective poles of a current source, a magnetic field generator being disposed so as to create a field which, in the presence of a current within said portion of the conductor, gives rise to electrodynamic forces tending to further offset said portion from said axis or to restore it thereto as the case may be, according to the sense or direction of the current, characterized by the fact that said portion is contained in a plane common to the remainder of the electrical conductor which forms said needle, the poles of said magnetic field generator are disposed on either side of this plane to give a uniform field whose lines of force are perpendicular to said plane, each needle comprises two symmetrical parts, one on either side of a plane passing through the straight line which joins the support to the guide means and perpendicular to the plane containing the needle, the adjacent portions of these symmetrical parts adjacent to the support being electrically insulated from one another and connected to the two terminals of said current source, the adjacent portions remote from said support being in electrical contact.

2. Printer according to claim 1, characterized by the fact that an ultrasonic transducer is associated with the writing surface.

3. Printer according to claim 1, characterized by the fact that said current source comprises a pulse generator connected to the primary of a transformer whose secondary is connected to one of said needles.

4. Printer according to claim 1, characterized by the fact that said conductors forming said needles are of rectangular section with the long axis of the section being located in the plane of the respective needle, a plurality of needles being stacked in the air gap of a permanent magnet which generates said magnetic field, with the interposition of electrical insulator between the needles, portions being arranged along the needles to produce articulation regions

5. Printer according to claim 1, characterized by the fact that an ultrasonic transducer is associated with the needles.

6. Printer according to claim 1, characterized by the fact that the conductors forming said needles are of constant rectangular shape with the long axis of the section being located in the plane of the respective needles, articulation regions being arranged along the needles by orienting the major axis of the rectangular section of the respective conductors perpendicularly to the plane of the needles, a stacking of these needles in the air gap of said magnet being achieved by interposition of iron blades in the portions of the needle where the major axis of its section is in the plane of the needles, to compensate for the lesser height occupied in the stack compared with said articulation regions.

7. Printer according to claim 5, in which the ultrasonic transducer is associated with one end of each of said needles, characterized by the fact that the section of the conductor is rectangular and constant with the major axis of this section being parallel to the magnetic field in the air gap of the magnet, that the total length of the needle corresponds to an integral multiple of the half-wavelength of said transducer when it is connected to said support at its nodal point situated equidistantly of its two ends.

8. Printer according to claim 1 characterized by the fact that said conductors forming said needles are of circular section.

9. Printer according to claim 4 characterized by the fact that a substantially rectangular section is obtained after flattening a wire of circular section.

* * * * *